US005079807A

United States Patent [19]

Hood

[11] Patent Number: 5,079,807

[45] Date of Patent: Jan. 14, 1992

[54] SHAPED PINTLE WIRE FOR PAPER MACHINE CLOTHING

[75] Inventor: Paul F. Hood, Glenmount, N.Y.

[73] Assignee: Albany International Corp., Albany, N.Y.

[21] Appl. No.: 369,766

[22] Filed: Jun. 22, 1989

[51] Int. Cl.[5] ..... F16G 3/02

[52] U.S. Cl. ..... 24/33 P; 24/33 B; 24/31 H; 24/33 K

[58] Field of Search ..... 24/573, 33 P, 33 R, 24/33 B, 33 C, 33 K, 33 M, 31 H

[56] References Cited

U.S. PATENT DOCUMENTS

| | | | |
|---|---|---|---|
| 1,610,315 | 12/1926 | Purple | 24/33 B |
| 1,638,466 | 8/1927 | Banks | 24/31 H |
| 1,698,100 | 1/1929 | Lee | 24/31 H |
| 1,827,783 | 10/1931 | Diamond | 24/33 B |
| 1,982,807 | 12/1934 | Henderson | 24/33 K |
| 3,309,790 | 3/1967 | MacBean | 24/33 K X |

OTHER PUBLICATIONS

Paper Machine Felts and Fabric, Albany International Corp., p. 34 (1976) (Albany).

*Primary Examiner*—Laurie K. Cranmer
*Attorney, Agent, or Firm*—Kane, Dalsimer, Sullivan, Kurucz, Levy, Eisele & Richard

[57] ABSTRACT

This disclosure shows a novel shaped pintle wire for papermachine clothing. The intended use of the pintle wire is to close a pin seam by joining the loops formed by the machine-direction yarns at each end of an open-ended papermachine fabric. The present pintle has a non-circular cross section with a major dimension and a minor dimension. The major dimension stretches the loops and reduces seam gap. The minor dimension is approximately equal to the thickness of the fabric under load. Both serve to reduce the marking of the paper sheet by the seam region.

9 Claims, 2 Drawing Sheets

SHAPED PINTLE WIRE FOR PAPER MACHINE CLOTHING

BACKGROUND OF THE INVENTION

1. Field of the Invention

This invention relates to the endless fabric belts used on papermaking machines to support, carry, and dewater the wet fibrous sheet as it is being processed into paper. It more specifically relates to seamed, rather than endless, fabrics, and to the pintles used to close the seam formed when the two ends of the fabric are joined during installation on the machine.

2. Description of the Prior Art

Endless fabric belts are key components of all three sections (forming, pressing, and drying) of the machines used to manufacture paper products. There, like a conveyor belt, they carry the wet fibrous sheet along as it is being converted into a paper product. At the same time, they provide needed support to the fragile, wet paper sheet and dewater it by accepting water which drains or is pressed therefrom.

Generally, these fabrics are supplied either in endless form, that is, woven in the form of an endless loop without a seam, or in open-ended form. The latter must be closed into endless form when installed on the papermachine. This will leave a seam running transversely across the fabric at the point where the two ends meet.

The so-called OMS (on-machine-seamed) fabrics are much easier to install on a papermachine position than those of the woven endless variety. To do so, one merely has to draw one end of the open-ended fabric through the machine and around the appropriate guide and tension rolls and other components. Then, the two ends can be joined at a convenient location on the machine and the tension adjusted to make the fabric taut. In practice, a new fabric is installed at the time an old one is being removed by connecting one end of the new fabric to the old fabric, which is used to pull the new fabric into proper position on the machine.

By way of contrast, the installation of an endless fabric is a much more difficult and time-consuming undertaking. The machine must, of course, be shut down and the old fabric cut out or otherwise removed. The new fabric must then be slipped into the machine from the side through spaces in the frame and around various machine components. This difficult job is compounded by the fact that the newer fabrics have been becoming increasingly bulkier and stiffer. This increases the time and effort necessary on the part of plant personnel to install a new one. Viewed in this light, the development of OMS fabrics has been a great boon.

The formation of the seam will be our primarily concern here. While there are a number of forms of such seams, we will be specifically interested in that known as the pin seam. This form of seam is more difficult to distinguish from the rest of the body of the fabric than those formed in other ways.

To close a pin seam, a thin cable, better known as a pintle, is passed down through the tunnel formed by the loops at each end of the fabric, when the two ends are brought together in such a way that the loops alternate and intermesh. The loops themselves are formed in one of two ways. In the first way, they are formed by the machine-direction yarns themselves, looped and woven back into the fabric. The second way employs a modification of the art of weaving "endless", which normally results in a continuous loop of fabric. According to the modification, the edges of the fabric are woven in such a way that the body yarns form loops, one set of alternating loops for each end of the woven cloth. In each way, the seam location will be nearly the same thickness as the rest of the fabric.

While the seam location might be of approximately the same thickness as the rest of the fabric, it most likely will not have the same physical properties. Specifically, it can turn out to have greater or lower permeability to air and water than the rest of the fabric depending upon the fit of the pintle, the permeability of the pintle itself, and any gap in the seam region In addition, under compression the seam region may behave differently than the rest of the fabric. The end result of these problems will be the periodic marking of the paper sheet by the seam. Although for some paper grades, and contemplated end uses, this may not be a serious problem, marking in general is undesirable.

Unfortunately, there is no ideal pintle. The present invention, however, provides a pintle having a cross section of novel shape, designed to reduce the marking of the paper sheet by the seam.

SUMMARY OF THE INVENTION

The present invention is a pintle wire for joining the loops formed by machine-direction yarns at the ends of an open-ended papermachine fabric to produce an endless press fabric with a pin seam. The pintle wire takes the form of an extruded monofilament and has a length at least as great as the width of the papermachine fabric.

As defined in *Fairchild's Dictionary of Textiles,* Fairchild Publications, Inc., New York, 1967, a "monofilament" is a single, generally coarse filament of man-made textile fiber.

The pintles of the present invention have non-circular cross sections. As such, the cross sections have a major dimension and a minor dimension. Shapes such as rectangles, ellipses, and flattened diamonds with rounded corners are but examples.

The major dimension lies in the plane of the fabric when the pintle is installed in the papermachine fabric. There, it stretches the loops at each end of the fabric to tighten the seam and to reduce any gap. The minor dimension, then, lies perpendicular to the plane of the fabric and makes the height of the pin seam under load approximately the same as the thickness of the papermachine fabric under load.

The ultimate purpose of the pintle wire of the present invention is to reduce the marking of the paper sheet by the seam region of the fabric. The invention will be described in more complete detail below.

DETAILED DESCRIPTION OF THE PREFERRED EMBODIMENT

Figure 1:
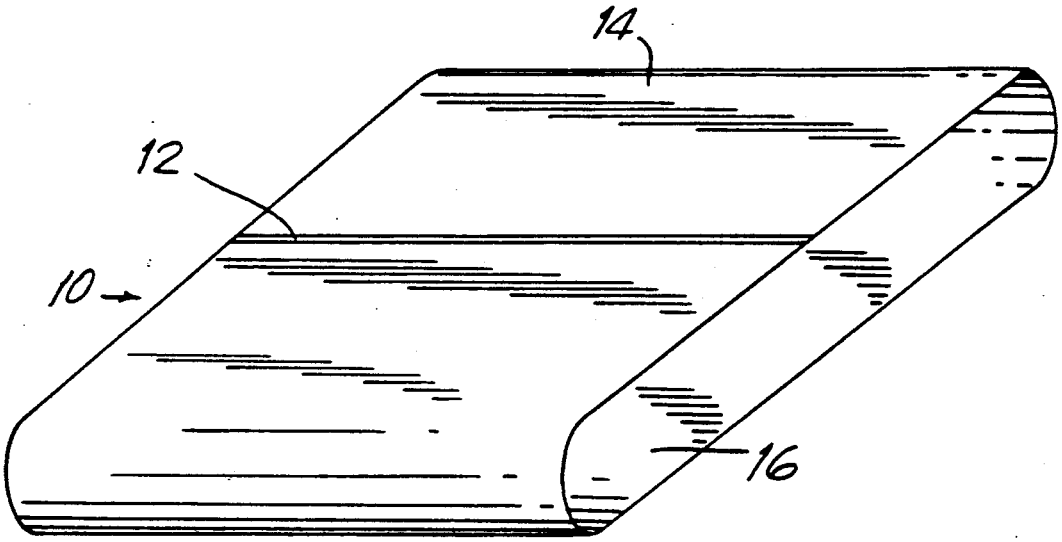
FIG. 1 is a perspective view of a papermachine fabric which has been closed into the form of an endless loop by means of a pin seam.

FIG. 1 is a perspective view of a papermachine fabric 10 which has been closed into the form of an endless loop by means of a pin seam 12. The papermachine fabric 10 has an outer surface 14 which carries and supports the wet paper sheet. It also has an inner surface 16, which contacts the components of the papermachine which drive the fabric.

Figure 2:
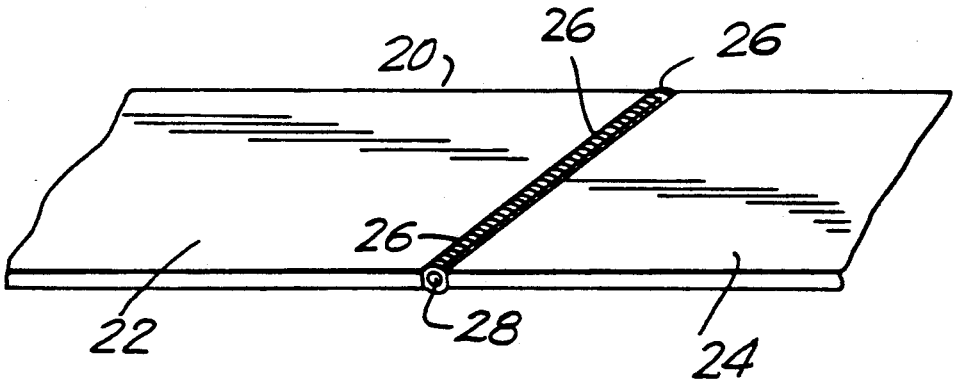
FIG. 2 is an enlarged, schematic view of a pin seam, formed by passing a pintle through the tunnel or space defined by the intermeshed loops at each end of a papermachine fabric.

FIG. 2 is an enlarged, schematic view of the pin seam region 20 of papermachine fabric 10. A first end 22 and a second end 24 of the papermachine fabric 10 are joined by alternating and intermeshing the loops 26 at the first end 22 and the second end 24. The pintle 28 joins the first end 22 to the second end 24 by being passed down the space formed by the intermeshed loops 26.

Figure 3:
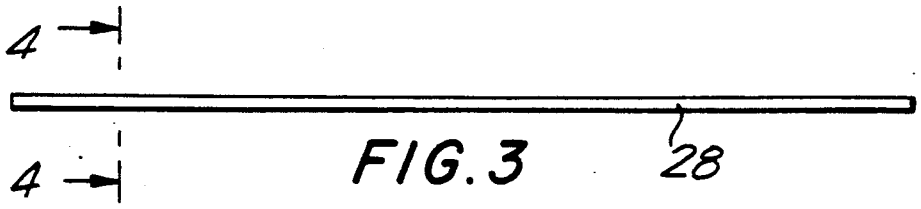
FIG. 3 is a side view of a pintle of the present invention.
Figure 4A:
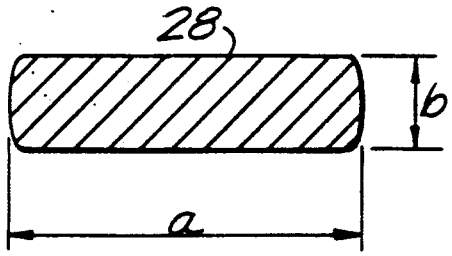
FIG. 4*a* through 4*c* show cross sections of several embodiments of the pintle taken as indicated in FIG. 3.
Figure 4B:
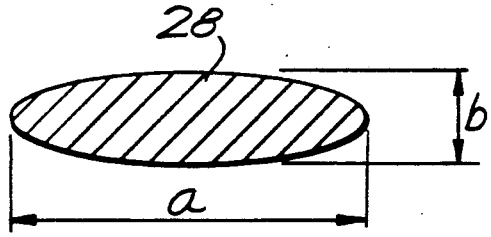
Figure 4C:
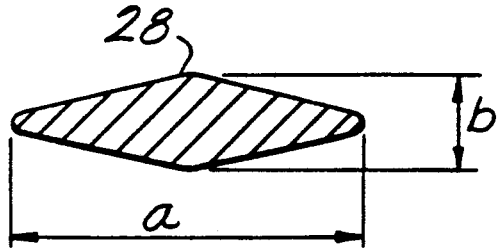

A side view of the pintle 28 is shown in FIG. 3. FIGS. 4*a* through 4*c* show cross sections of several embodiments of the pintle 28 taken at the point indicated in FIG. 3. All are generally non-circular, in accordance with the requirements of the present invention, and have what might be referred to as a major dimension, shown as "a" in FIG. 4*a* through 4*c*, and a minor dimension, shown as "b". FIGS. 4*a* through 4*c* show shaped cross sections which are rectangular, elliptical, and flattened diamond-shape. All are shown with rounded corners. These three shapes are shown merely as examples. Others, falling within the scope of the appended claims, can easily be designed.

As already noted, the desire to reduce sheet marking has provided the motivation for the present invention. The major dimension of the cross section of the pintle is designed to stretch the loops in the machine direction to tighten the seam and to reduce or eliminate any gaps. The minor dimension is designed to be as thick as the papermachine fabric under compression.

Naturally, these pintle dimensions depend on the parameters of the papermachine fabric whose ends are to be joined. Specifically, fabric thickness, or caliper, as well as loop sizes will vary. The pintle dimensions, therefore, must be chosen to suit the particular application.

Samples of the pintle, whose cross section is shown in FIG. 4*c*, having dimensions as set forth in the table below, have been produced.

| a (in) | b (in) |
|---|---|
| .046 | .025 |
| .055 | .030 |
| .062 | .034 |
| .068 | .039 |
| .071 | .040 |
| .140 | .070 |

Modifications to the above would be obvious to anyone skilled in the arts to which this subject matter pertains without departing from the scope of the appended claims.

What is claimed is:

1. A pintle wire for joining an open-ended papermachine fabric to produce an endless press fabric with a pin seam, said open-ended fabric having a first end and a second end, each of said ends having loops formed by machine-direction yarns looped and woven back into said fabric, said loops at said ends being alternated and intermeshed to form a passage therethrough for the insertion of said pintle wire when said first end and said second end are brought together to form said pin seam, wherein said pintle wire is a monofilament, said monofilament being a single filament of man-made textile fiber, said monofilament having a length at least as great as the width of said papermachine fabric and having a non-circular cross section with a major dimension and minor dimension, said major dimension to lie in the plane of said papermachine fabric and to stretch said loops formed by said machine-direction yarns to draw said pin seam tighter and to reduce any gap in said pin seam, and said minor dimension to lie perpendicular to the plane of said fabric and to make the height of said pin seam under load approximately the thickness of said papermachine fabric under load.

2. A pintle wire as claimed in claim 1 wherein said non-circular cross section is rectangular.

3. A pintle wire as claimed in claim 1 wherein said non-circular cross section is elliptical.

4. A pintle wire as claimed in claim 1 wherein said non-circular cross section has a flattened diamond shape with rounded corners.

5. In the combination which includes an open-ended papermachine fabric of the type joinable into endless form by means of a pin seam to produce an endless press fabric with a pin seam, said open-ended papermachine fabric having a first end and a second end, each of said ends having a plurality of loops formed by machine-direction yarns looped and woven back into said fabric, and a pintle wire, said pintle wire securing said pin seam when said first end and said second end are brought together with said plurality of loops at said first end being alternated and intermeshed with said plurality of loops at said second end to form a tunnel-like passage through which said pintle wire is inserted, the improvement which comprises:

a pintle wire in the form of a monofilament, said monofilament being a single filament of man-made textile fiber, said monofilament having a length at least as great as the width of said papermachine fabric and having a non-circular cross section with a major dimension and a minor dimension, said major dimension to lie in the plane of said papermachine fabric and to stretch said loops formed by said machine-direction yarns to draw said pin seam tighter and to reduce any gap in said pin seam, and said minor dimension to lie perpendicular to the plane of said fabric and to make the height of said pin seam under load approximately the thickness of said papermachine fabric under load.

6. In the combination as claimed in claim 5 a pintle wire having a non-circular cross section of rectangular shape.

7. In the combination as claimed in claim 5 a pintle wire having a non-circular cross section of elliptical shape.

8. In the combination as claimed in claim 5 a pintle wire having a non-circular cross section of a flattened diamond shape with rounded corners.

9. In the combination as claimed in claim 5 an open-ended papermachine fabric woven by modified endless weaving, whereby said machine-direction yarns, forming said plurality of loops at said first end and said second end of said open-ended papermachine fabric, run continuously between said first and and said second end.

* * * * *